United States Patent [19]

Weirich et al.

[11] 4,247,226

[45] Jan. 27, 1981

[54] HYDRAULIC CONDUIT SYSTEMS FOR MINE INSTALLATIONS

[75] Inventors: Walter Weirich, Dortmund; Michael Dettmers, Kamen, both of Fed. Rep. of Germany

[73] Assignee: Gewerkschaft Eisenhutte Westfalia, Lunen, Fed. Rep. of Germany

[21] Appl. No.: 968,682

[22] Filed: Dec. 12, 1978

[30] Foreign Application Priority Data

Dec. 31, 1977 [DE] Fed. Rep. of Germany ..... 2759223

[51] Int. Cl.[3] ..... E21D 23/16

[52] U.S. Cl. ..... 405/302; 91/170 MP

[58] Field of Search ..... 405/291, 299–302; 91/170 MP

[56] References Cited

U.S. PATENT DOCUMENTS

| | | | |
|---|---|---|---|
| 3,246,576 | 4/1966 | Kibble et al. | 405/302 X |
| 3,606,758 | 9/1971 | Gotze | 405/302 X |

FOREIGN PATENT DOCUMENTS

| | | | |
|---|---|---|---|
| 1902194 | 9/1970 | Fed. Rep. of Germany | 405/302 |
| 1038262 | 8/1966 | United Kingdom | 91/170 MP |
| 1095112 | 12/1967 | United Kingdom | 91/170 MP |

*Primary Examiner*—David H. Corbin

*Attorney, Agent, or Firm*—Thompson, Birch, Gauthier & Samuels

[57] ABSTRACT

In a mine installation which employs a winning machine moved back and forth along a guide in a working and coupled via shifting rams to roof supports, the invention provides a hydraulic fluid supply conduit system for supplying the pressure fluid for operating the shifting rams and the props of the roof supports. The system employs a first conduit containing fluid at a pressure of 300 to 400 bars for setting the props of the roof supports, a second conduit containing fluid at a pressure of 100 to 200 bars for use as a robbing aid during retraction of the props, a third conduit containing fluid at a pressure of 100 to 200 bars for operating the shifting rams and a common fluid return conduit. The conduits are laid along the working and the first and the second or third conduits are fed by separate pumps in a heading or gallery while the third or second conduit is connected via a pressure-reducing valve to the pump feeding the first conduit. The cross-sections of the conduits are designed in a specific relationship defined hereinafter, to provide adequate pressure fluid flow while maintaining the desired pressure levels and minimizing back pressure.

6 Claims, 1 Drawing Figure

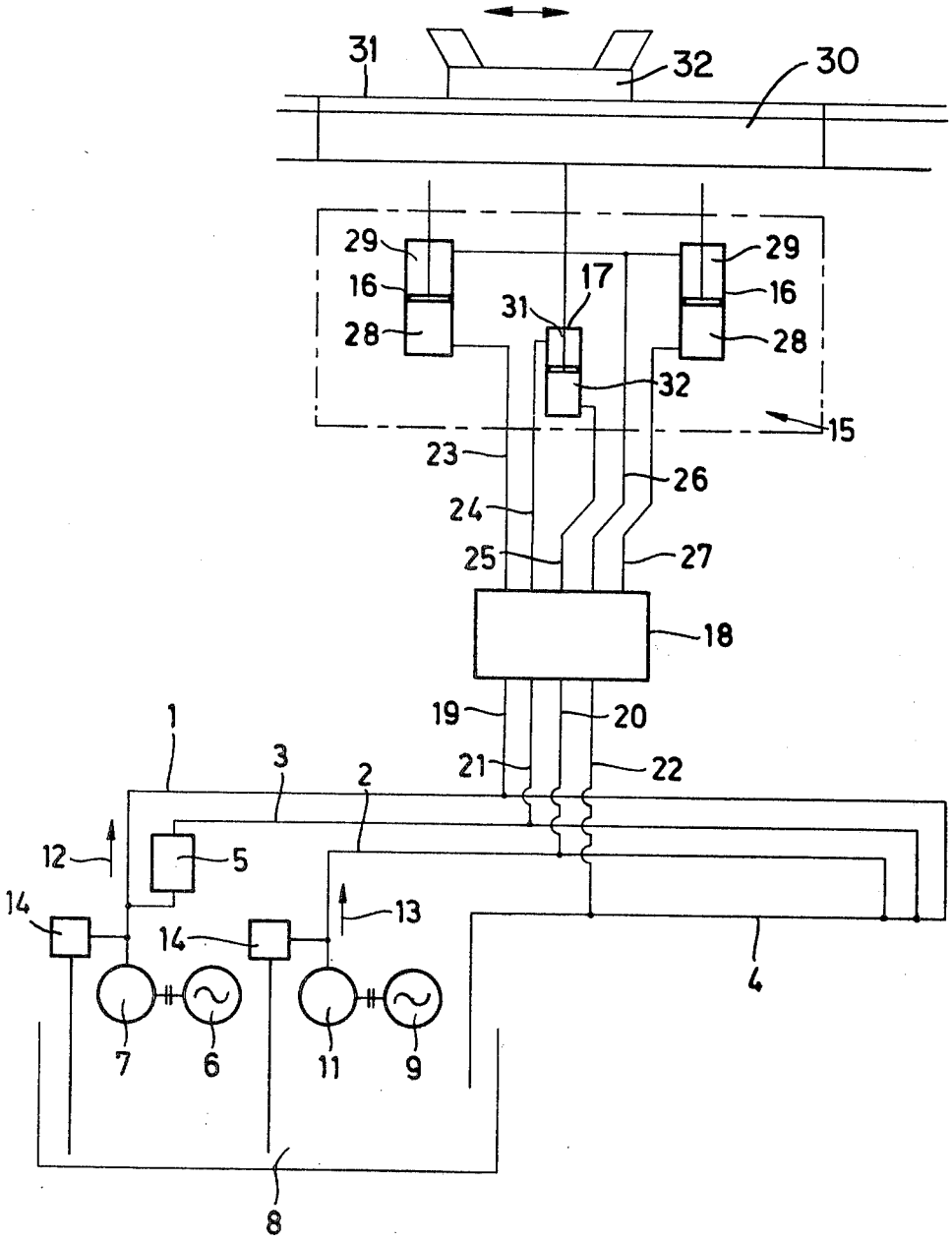
31
32
30
29
16
28
17
31
29
16
28
32
15
23
24
25
26
27
18
19
20
21
22
1
3
2
12
5
14
13
14
4
7
6
11
9
8

HYDRAULIC CONDUIT SYSTEMS FOR MINE INSTALLATIONS

BACKGROUND TO THE INVENTION

The present invention relates in general to mineral mining installations and, more particularly, to hydraulic pressure fluid supply conduit systems designed for use in such installations.

It is well known to utilize a winning machine, such as a plough or shearer, which is moved back and forth along a mineral face in an underground working. A series of roof supports or chocks are usually arranged along the working and the mineral is transported away by a scraper-chain conveyor extending alongside the mineral face and conveniently supporting a guide for the winning machine. Each of the roof supports employs one or more hydraulic props which need to be set to brace the supports between the roof and floor of the working and relieved and/or retracted when the support is to be advanced. To advance the supports on the one hand and the conveyor and the winning machine on the other hand, double-acting hydraulic rams are connected between the supports and the conveyor. The shifting rams have to urge the conveyor and hence the winning machine against the mineral face with a certain force to produce the desired depth of cut. The various hydraulic appliances used in the installation and primarily the props and shifting rams need to be reliably supplied with pressure fluid to cause the appliances to operate.

In its simplest form, a hydraulic fluid conduit system would employ a pressure feed line or conduit connected selectively to the working chambers of the appliances to be charged with fluid and a return line or conduit connected selectively to the working chambers of the appliances to be evacuated. Normally, control valves or devices would be used to switch the connections between the feed and return lines and the appropriate working chambers of the appliances. Generally speaking, the hydraulic appliances operate under different operating conditions. For example, during shifting of the conveyor, one shifting ram may encounter a greater resistance to shifting than another ram. Similarly, one prop may need to be extended or retracted to a greater extent than another. The quantity of hydraulic pressure fluid drawn off from the feed line can thus very considerably from one appliance to another and regions of the feed line can be exposed to back pressure. As a result, different pressures can be established in the feed line over the length of the working and appliances such as the shifting rams may be charged with fluid at somewhat different pressure. One result of this problem is that the individual sections of the conveyor may be exposed to different forces when the shifting rams urge the conveyor and the machine against the mineral face. Consequently, it is not possible to maintain a reasonably constant depth of cut and the cut face cannot be held straight, as is desirable.

Once deviations occur in the face, problems occur, since the cutters of the machine can suddenly encounter high friction, which can cause fracture of the cutters or of components of the machine drive means.

A general object of the present invention is to provide an improved hydraulic fluid supply conduit system which will mitigate the problems mentioned.

SUMMARY OF THE INVENTION

In a mineral mining installation of the type described, the present invention provides a hydraulic fluid supply conduit system which has a first pressure fluid feed conduit, a second pressure fluid feed conduit and a pressure fluid return conduit which provides a common return path for both the first and second conduits. The conduits are laid along the main working and means, such as control valves or devices, are used in known manner to selectively connect the conduits to the hydraulic appliances, e.g., props and shifting rams of the installation. Means, including a pump, arranged in a heading or gallery outside the main working, delivers a substantially constant delivery quantity of pressure fluid to both the first and second conduits to establish a pressure in the first conduit of about 300 to 400 bars and a pressure in the second conduit of about 100 to 200 bars. A pressure-reducing valve may be used to feed fluid from the pump to the second conduit to create this lower pressure therein. To mitigate the problems mentioned hereinbefore, the cross-sections of the conduits have a specific relationship, VIZ:—the first pressure conduit has a cross-section below an optimum for fluid flow; the second pressure conduit has a cross-section equal to or greater than that of the first-pressure conduit and produces a pressure drop below about 5 bars at a fluid delivery rate of about 60 liters/minute; and the return conduit has a cross-section at least 1.5 times that of the first pressure conduit.

It has been found that a system constructed in accordance with the invention can provide adequate inflow and outflow of fluid, minimizes back pressure and, above all, can ensure reasonably regular forces exerted by the shifting rams of the mine installation associated therewith.

In the case of especially long workings, it is desirable to employ a further pressure fluid feed conduit in which a pressure of about 100 to 200 bars is established. Preferably, this is accomplished by a further pump feeding just the further conduit.

In one specific embodiment of the invention, the first pressure conduit is connected with a working chamber of one of the props to effect extension and setting of said prop while the return conduit is connected to the other working chamber of said prop during the setting operation, the return conduit is connected to said one chamber of the prop while the second pressure conduit is connected to the other chamber to effect retraction of said prop and wherein the further pressure conduit and the return conduit are connected with respective working chambers of a shifting ram to effect shifting of one of the support units or the guide.

The invention may be understood more readily and various other features of the invention may become apparent from consideration of the following description.

BRIEF DESCRIPTION OF DRAWING

An embodiment of the invention will now be described, by way of example only, with reference to the accompanying drawing, which is a schematic representation of a system made in accordance with the present invention.

DESCRIPTION OF PREFERRED EMBODIMENT

As shown in the drawing, a hydraulic fluid supply conduit system for an underground mineral mining installation employs individual pressure feed lines or conduits 1, 2, 3 and a common pressure return line or conduit 4. During operation, the pressure feed line 1 contains pressure fluid at a pressure level of between 300 and 400 bars and the pressure feed lines 2,3 contain pressure fluid at a pressure level between 100 and 200 bars. The return line 4 returns the fluid from the lines 1, 2 3 back to a reservoir 8. A pump 7 is driven by a motor 6 to draw in fluid from the reservoir 8 and delivers a constant delivery quantity of fluid directly to the pressure line 1, as indicated by the arrow 12. A pressure-reducing valve 5 is connected from the output of the pump 7 to the line 3 to thus provide the reduced pressure level for the line 3. A second pump 11 driven by its own motor 9 takes in fluid from the reservoir 8 and delivers a constant delivery quantity of fluid to the pressure line 2, as indicated by the arrow 13. The outputs from the pumps 7,11 are also connected to safety valves 14 which can feed fluid directly back to the reservoirs 8 if faults occur. In order to overcome the problems mentioned previously, the conduit 1 has a cross-section somewhat less than that calculated to be optimal, the return conduit 4 has a cross-section at least 1.5 times that of the conduit 1 and the conduits 2,3 each has a cross-section at least equal to or greater than that of the conduit 1 and produce a pressure drop not exceeding 5 bars when the rate of delivery of fluid fed thereto is about 60 liters/minute at 100–200 bars.

The pumps 7,11, the motors 6,9, the valves 14 and the reservoir 8 are arranged in a heading or gallery roadway of the mine while the lines or conduits 1–4 are laid along the actual working where mineral is being won. In this actual working, roof support units are arranged and one such unit is depicted in the drawing, by way of example, and is generally designated 15. The support units 15 are disposed at the goaf side of an elongage guide 31 more usually mounted to a scraper-chain conveyor 30, along which a winning machine 32, such as a plough, is moved back and forth to win mineral from the mineral face. Each unit 15 employs two hydraulic props 16 and shifting rams 17 are coupled between the units 15 and the guide 31, e.g. the conveyor 30. The props 16 of each unit 15 each have working chambers 28,29 and the associated ram 17 has working chambers 31,32. The unit 15 is associated with a control device 18 which is connected via conduits 19,20,21,22 to the pressure lines 1,2,3, and the return line 4 respectively. The device 18 is also connected via conduits 23,24,25,26 and 27 to the working chambers 28,31,32,29 and 28, respectively, of the props 16 and the ram 17, as shown. The device 18 is actuated in any suitable manner to establish connection between the goups of conduits 23–27 and 19–22. During operation, the pumps 7,11 establish the desired pressure level in the conduits 1,19,2,20 and 3,21 as described. In order to extend and set the props 16 in the roof supporting position, the chambers 28 are charged with pressure fluid by setting the device 18 to connect the conduits 23,27 to the conduit 19. At the same time, the device 18 connects the common conduit 26 to the conduit 22 to thereby connect the working chambers 29 of the props 16 to the return line 4. When the props 16 are to be retracted, the chambers 29 are exposed to pressure fluid as a robbing aid. In this case, the device 18 is set to connect the conduit 26 to the conduit 21 and, at the same time, the conduits 23,27 are connected to the conduit 22 and thence to the return line 4.

When it is desired to advance part of the mineral winning installation, such as a section of the conveyor 30 with part of the guide 31 supporting the winning machine 32, to follow the working progress, it is necessary to ensure that the props 16 are properly set before the ram 17 is extended. In this operation, the device 18 is set to connect the conduit 25 to the conduit 20 and the conduit 24 to the conduit 22.

When it is desired to shift the unit 15 to follow up the advancement of the section of the conveyor 30 and guide, the props 16 are relieved and preferably at least partially retracted and the device 18 is then set to connect the conduit 24 to the conduit 20 and the conduit 25 to the conduit 22.

We claim:

1. In a mineral winning installation, an improved hydraulic conduit system comprising: a first pressure fluid feed conduit; a second pressure fluid feed conduit, a pressure fluid return conduit providing a common fluid return path for both the first and second pressure conduits, the conduits being selectively connectible to appliances of the installation to operate such appliances; and means, including a pump, for delivering pressure fluid at a substantially constant delivery quantity to the first and second conduits to establish a higher pressure in the first conduit in the range 300 to 400 bars and a lower pressure in the second conduit in the range 100 to 200 bars, wherein:

(i) the first pressure conduit has a cross-section below an optimum for fluid flow;

(ii) the second pressure conduit has a cross-section equal to or greater than that of the first pressure conduit and produces a pressure drop below about 5 bars at a fluid delivery rate of about 60 liters/minute; and (iii) the return conduit has a cross-section at least 1.5 times that of the first pressure conduit.

2. A system according to claim 1, wherein a further pressure fluid feed conduit is provided and said delivery means serves to establish a lower pressure in the further conduit in the range 100 to 200 bars.

3. A system according to claim 2, wherein said delivery means has a further pump for delivering pressure fluid at a substantially constant delivery quantity to the further conduit and a pressure-reducing valve, which is connected between the outlet of the first-mentioned pump and said second pressure conduit.

4. A mineral mining installation comprising roof support units with hydraulically-operated telescopic props arranged in a mine working, a mineral winning machine, a guide for guiding the machine for movement back and forth along a mineral face, shifting rams disposed between the guide and the support units, control means for selectively operating the rams and the props of the units and a hydraulic fluid supply conduit system comprising a first pressure fluid feed conduit, a second pressure fluid feed conduit, a pressure fluid return conduit providing a common fluid return path for both the first and second pressure conduits, said conduits extending along said working and being connected to said control means to feed fluid to and from the selected props and rams and means, including a pump, arranged in a heading or gallery at one end of the working for delivering pressure fluid at a substantially constant delivery quantity to the first and second conduits to establish a higher pressure in the first conduit in the range 300 to 400 bars and a lower pressure in the second conduit in the range 100 to 200 bars, wherein:

the first pressure conduit has a cross-section below an optimum for fluid flow;

the second pressure conduit has a cross-section equal to or greater than that of the first pressure conduit and produces a pressure drop below about 5 bars at a fluid delivery rate of about 60 liters/minute; and the return conduit has a cross-section at least 1.5 times that of the first pressure conduit.

5. An installation according to claim 4, wherein a further pressure fluid feed conduit is provided and said delivery means has a pressure-reducing valve connected between the outlet of the first-mentioned pump and the second pressure conduit and a further pump for delivering pressure fluid at a substantially constant delivery quantity to said further conduit to establish a lower pressure in the further conduit in the range 100 to 200 bars.

6. An installation according to claim 5, wherein the first pressure conduit is connected with one working chamber of one of the props to effect extension and setting of said prop while the return conduit is connected to the other working chamber of said prop during the setting operation, the return conduit is connected to said one working chamber of the prop while the second pressure conduit is connected to said other working chamber to effect retraction of said prop and wherein during a shifting of the support units, the props are relieved and the further pressure conduit and the return conduit are connected with respective working chambers of a shifting ram to effect shifting of one of the support units or the guide.

* * * * *